US010196763B2

(12) United States Patent
Debnath et al.

(10) Patent No.: US 10,196,763 B2
(45) Date of Patent: Feb. 5, 2019

(54) AIR RICH YARN AND FABRIC AND ITS METHOD OF MANUFACTURING

(75) Inventors: Pradip Debnath, Barnala (IN); Swadesh Verma, Barnala (IN)

(73) Assignee: Trident Limited (IN)

( * ) Notice: Subject to any disclaimer, the term of this patent is extended or adjusted under 35 U.S.C. 154(b) by 268 days.

(21) Appl. No.: 13/242,409

(22) Filed: Sep. 23, 2011

(65) Prior Publication Data

US 2012/0076971 A1 Mar. 29, 2012

(30) Foreign Application Priority Data

Sep. 24, 2010 (IN) ..... 1867/DEL/2010

(51) Int. Cl.
*D02G 3/40* (2006.01)
*D02G 3/04* (2006.01)
*D03D 15/06* (2006.01)

(52) U.S. Cl.
CPC ..... *D02G 3/406* (2013.01); *D02G 3/04* (2013.01); *D03D 15/06* (2013.01); *Y10T 428/249921* (2015.04); *Y10T 442/30* (2015.04); *Y10T 442/40* (2015.04)

(58) Field of Classification Search
None
See application file for complete search history.

(56) References Cited

U.S. PATENT DOCUMENTS 4,164,603 A * 8/1979 Siggel et al. ..... 428/398
4,544,594 A * 10/1985 Li et al. ..... 428/92
5,577,307 A * 11/1996 Itoi ..... 28/168
2002/0150756 A1* 10/2002 Tanaka et al. ..... 428/364
2004/0131821 A1* 7/2004 Mandawewala ..... 428/97
2005/0102992 A1* 5/2005 Yanagihara ..... B29C 41/18 57/246
2007/0087162 A1* 4/2007 Mandawewala ..... 428/97
2008/0083047 A1* 4/2008 Prickett ..... 2/16
2010/0300576 A1* 12/2010 Liu ..... D02G 3/04 139/35

FOREIGN PATENT DOCUMENTS

EP 2 172 583 A1 4/2010
JP 5-117966 A 5/1993
WO WO 2008154866 A1 * 12/2008 ..... D02G 3/04
WO WO 2009/098583 A1 8/2009

OTHER PUBLICATIONS

Havis, Simon "Wool/PVA fiber Production Technology" Crimp Wool and Technology, Feb. 1997, pp. 1-50, No. 77, XP-002636820.
European Search Report for EP 11 18 2724, dated Feb. 16, 2012.

* cited by examiner

*Primary Examiner* — Chinessa T. Golden
(74) *Attorney, Agent, or Firm* — Lerner, David, Littenberg, Krumholz & Mentlik, LLP

(57) ABSTRACT

The present invention relates to air rich yarn and fabric with pores throughout the cross-section. Air rich yarn and fabric have high wettability, easy dryability, quick absorbency and increased thickness. When air rich yarn is used to make terry fabric it makes thicker fabric with increased capacity to absorb water and also release moisture faster while drying.

16 Claims, 3 Drawing Sheets

AIR RICH YARN AND FABRIC AND ITS METHOD OF MANUFACTURING

CROSS-REFERENCE TO RELATED APPLICATIONS

This application claims the benefit of priority to Indian Patent Application No. 1867/DEL/2010, filed on Sep. 24, 2010, the disclosure of which is hereby expressly incorporated by reference in its entirety.

FIELD OF THE INVENTION

The present invention describes novel "air rich fabric" and "air rich yarns" with pores throughout the cross-section. The present invention also describes the process for manufacturing air rich fabrics and yarns. In particular, the invention is directed at producing air rich fabrics and yarns which have high wettability, easy dryability, quick absorbency and increased thickness. The air rich fabrics having increased thickness have added advantage of keeping the body warm as they do not allow the body's heat to transmit easily through the fabric.

BACKGROUND

Fabric is a flexible material consisting of a network of natural or artificial fibers often referred to as thread or yarn. Yarn is produced by spinning raw fibers such as wool, linen, cotton, or other natural or manmade material on a spinning wheel to produce long strands. Fabrics are formed by weaving, knitting or by non-woven techniques.

The fabrics woven and terry woven are made from, for example, 100% cotton fiber yarns, fiber blends in yarns like: cotton and viscose, blends of cotton and modal, blends of silk and modal; bamboo fiber yarns; and blends of cotton and bamboo yarns.

Flat fabrics, such as sheeting or apparel, may be made from 100% cotton; blends of polyester and cotton; blends of polyester and viscose; blends of cotton and modal; blends of cotton, silk and modal; and any combinations thereof.

Further, most fibers have absorbent properties but the extent of absorption depends on the type of fiber, nature of yarn used and the design of the fabric etc.

However, by suitable modifications in the yarn structure, it is possible to increase the wicking property of the yarn, in effect increasing the hydrophilic nature, thereby making the yarns quick absorbing and bulky.

Terry Towels are generally thick materials. The thicker the towel, the greater the surface area, and thus a greater amount of water can be absorbed. When a towel fabric encounters a water droplet, the pile loops first remove the droplet by sucking the droplet between the space available among the pile loops and then absorbing the water inside the yarn in the space between the fibers in the yarn. The latter part applies to flat fabrics as well. The absorbed water then enters the secondary wall and in lumen of the cotton fiber.

The amount of twist in the yarn affects the properties of the towel products. The pile yarn is generally a low-twist yarn. Pile loops provide maximum surface area for the absorption of water, and the low twist aids in the absorption by imparting wicking properties to the yarn. Ground warp and weft are generally hard-twisted compared to the pile yarn. The ground and weft yarn twist factors generally range from about 3.8 to about 4.2, depending upon the towel construction. In contrast, the twist factor in the pile yarn generally ranges from about 3.2 to about 3.9. Similarly in the case of flat fabrics the twist factor for warp and weft range from about 3.8 to about 4.5.

The yarns normally used in terry fabrics are coarse and range from Ne (Number English) 8s to 30s in single as well as doubled configuration for pile, weft and ground yarns.

Similarly the warp and weft yarn count, in the case of flat fabrics range from Ne. 12s to Ne. 100s in single as well as doubled configuration depending on the construction of fiber, their blends and the structure of the yarn made thereof.

Decorative designs and embellishments are formed using polyester filament, polyester spun yarn, viscose filament yarn, viscose spun yarn, mercerized cotton yarn, cotton linen fiber blended yarns, Ramie cotton fiber blended yarn, modal fiber yarns, chenille yarn, modified viscose fiber yarn, and combinations thereof. Other flat fabrics such as sheeting or apparel are made from 100% cotton fiber yarn; fiber blends of polyester and cotton; blends of polyester and viscose; blends of cotton and modal, blends of cotton and silk and modal; blends of cotton and bamboo; blends of cotton and sea weed fibers; blends of cotton and sliver fibers; blends of cotton and charcoal fibers; and any combinations thereof.

The greater the amount of free air space available within the yarn, the quicker and higher absorption of the water. Hence, to increase the amount of free spaces, (as the air space increases, the drying of the towel after absorption also increases) structural changes in the yarn have to be made.

Polyvinyl alcohol ("PVA"), a man made fiber, has the unique property of dissolving in hot water. Earlier invention(s) exploits the dissolving property of PVA by introducing PVA into blended yarns and, for example, in core of the cotton yarn.

There are various methods of introducing PVA into cotton yarn via cotton spinning system. These methods have been exploited earlier. These methods are:

a) Inserting PVA fibers into the core during ring spinning, by inserting PVA spun yarn into the stream of cotton fibers in the drafting zone during ring spinning on Ring Frame.

b) Blending the PVA roving with the cotton roving during feeding in the drafting system of ring frame in SIRO spinning system.

c) Inserting PVA fiber slivers into the middle of cotton slivers at the feeding end of the drafting zone of the speed frame, twisting on the speed frame, and subsequently spinning the yarn at ring spinning.

d) Blending PVA fiber along with cotton fiber in the initial process of fiber mixing in cotton spinning system.

e) Doubling PVA yarn with cotton yarn with twist in reverse direction of cotton yarn leaving the final finished fabric with cotton yarn having only few turns of twist.

By using methods (a), (b) and (c) the blend homogeneity, across the radial direction in the final yarn structure, can not be ascertained. Also, by using these methods well interlinked 'through pores' through out the cross section of the yarn and on the surface of the yarn cannot be achieved. The pores formed are mainly of 'closed' and 'blind' type. The yarn made by these methods may be hollow in core but the surface is covered. Covered surface does not allow water to go inside the core in hollow space so easily. These methods are thus, not effective to attain the porous yarn structure in the final fabric. The structural difference in these yarn structure and invented can be well understood from schematic diagram in FIG. 1.

By using process (d) porous yarn structure in the final fabric can be attained. This process has operational challenges in blended process due to entirely different processing behavior of PVA fibers.

Process (e) involves separate spinning process for PVA yarn and Cotton Yarn. Therefore an additional cost of doubling process with PVA yarn is added making the process cost ineffective. Also structure of the yarn is open fiber structure which causes negligible binding of the fibers.

Thus, there is a need for an economic and cost effective process of manufacturing air rich fabric/yarns with pores throughout the cross section.

SUMMARY OF THE INVENTION

An object of the present subject matter is to provide a method for manufacturing fabrics, which are highly wettable, easily dryable, quick absorbing, thicker (voluminous). The fabrics have an added advantage of keeping the body warm and not allowing the body heats to transmit easily from the fabric (herein referred to as "Air rich fabrics").

Another object of the present subject matter is to provide a method for manufacturing Terry fabrics that can absorb about 75% to 100% of the water contacting them and dry with a drying rate 10 to 30% faster than normal fabric.

Yet another object of the present subject matter is to provide Air rich fabrics/yarns with pores through out the cross section and on the surface as well.

To achieve the said objectives, this invention provides a process of manufacturing Air rich fabrics. The process involves blending water soluble fibers (e.g. PVA fibers) with the base fibers (e.g. cotton fibers). Modified method of blending water soluble fiber slivers along with base material fiber slivers on the draw frame of a spinning system. Further, giving one more draw frame passage for achieving the blending homogeneity in radial direction. This method helps in achieving pores through out the surface of the final yarn and making the porous yarn structure in the final fabric stage.

The process used in the present invention simplifies the processing of water soluble material fiber blended with base material fiber and eliminates the cost of manufacturing water soluble material roving or yarn.

BRIEF DESCRIPTION OF DRAWINGS

These and other features, aspects, and advantages of the present invention will become better understood when the following detailed description is read with reference to the accompanying drawings, wherein.

DEFINITIONS

Figure 1:
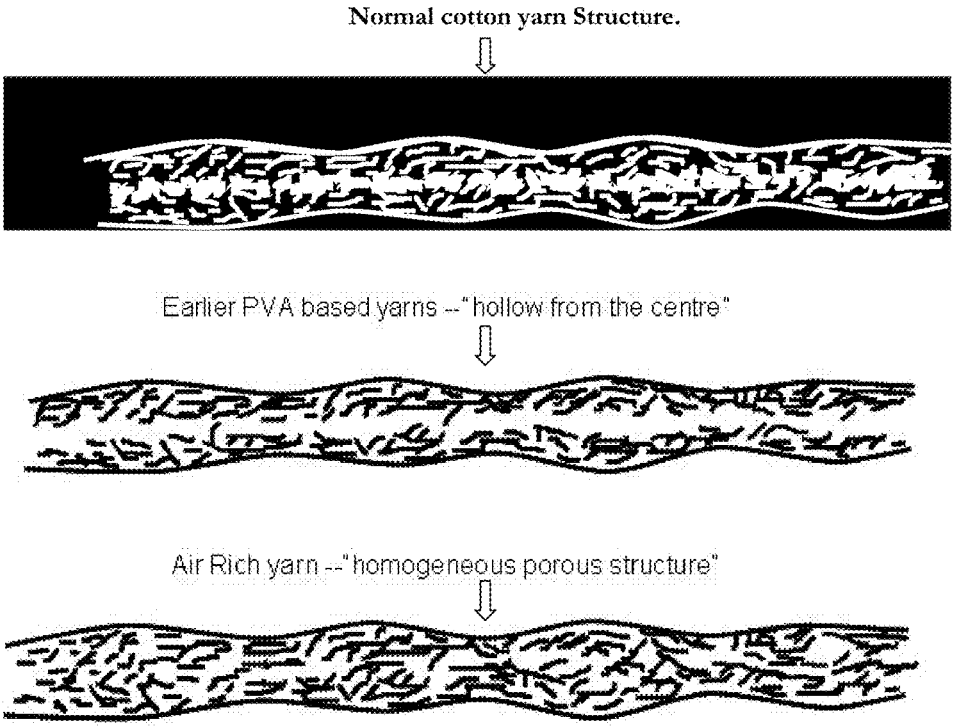
FIG. 1 illustrates difference between core based PVA Yarn and Air Rich Yarn Structure

English count (Ne)—Number of hanks of 840 yards per pound.

Absorbency—The propensity of a material to take in and retain liquid, usually water.

Blend—A textile containing two or more different fibers, variants of the same fiber or different colors and grades of the same fiber.

Blending—The mixing of quantities of the same fiber taken from many lots or of different types of fiber to produce a uniform result.

Carding—A process in manufacturing spun yarn in which the fibers are separated, distributed, equalized and formed into a web. The web can be very thin or thick. The process of carding removes some impurities, and a certain amount of short or broken fibers.

Core Spinning—A yarn spinning process using which a filament (usually elastic under tension) is covered with a sheath of staple fibers to produce stretchable yarn. The resultant yarn and fabric have the characteristics of the sheath fiber along with the advantage of stretch and recovery.

Core Yarn: A yarn made by winding one yarn/fiber around another to give the appearance of a yarn made solely of the outer yarn.

Denier: Refers to the thickness of a fiber. It is the measurement of the diameter of the fiber and refers to weight in grams for 9000 meters.

Hank: A definite length of textile material that varies according to the material. A hank of wool is 560 yards, cotton and silk is 840 yards, and linen is 300 yards.

Pile: A surface effect on a fabric formed by tufts or loops of yarn that stand up from the body of the fabric such as terry towel fabric.

Spinning: The final step in the production of yarn. The twisting of fibers in the form of the sliver or roving.

Warp: In woven fabric, the yarns that run lengthwise and are interwoven with the fill (weft) yarns.

Weft: In woven fabric, the filling yarns that runs perpendicular to the warp yarns.

Yarn: A continuous strand of textile fibers created when a cluster of individual fibers are twisted around one another.

Base material—cotton, cotton blends, silk, modal fibers, acrylic, blends of cotton and bamboo, blends of cotton and sea weeds, blends of cotton and silver, blends of cotton and charcoal, blends of polyester and cotton, blends of polyester and viscose, blends of cotton and modal and combinations thereof.

Water soluble material—material having unique property of dissolving in hot water, e.g. polyvinyl alcohol ("PVA"), a man made fiber.

PVA—A synthetic polymer available in the form of filaments and cut fibers. PVA fibers are easily dissolved in warm or hot water at about 40 degree Celsius to 110 degree Celsius without the aid of any chemical agents.

Sliver—It is a continuous strand of loosely assembled fibers without twist. The production of the sliver is the first step in the textile operation that brings the staple fiber into a form that can be drawn and eventually twisted into a spun yarn.

Porosity: Porosity is the ratio of the volume of openings (voids) to the total volume of material. Porous surface of the yarn having more big size air gaps in the yarn structure for quick absorbing and early shedding of water that is being absorbed.

Through Pores: Open to outside and permit fluid flows

Thermal Insulation: It is a measure of amount of heat a fabric can resist from its surface to dissipate in to the atmosphere Wettability: Wettability or wetting is the actual process when a liquid spreads on a solid substrate or material. It can be estimated by determining the contact angle or calculating area of spreading or time taken to spread.

DETAILED DESCRIPTION

The present invention relates to novel air rich fabric/yarns with pores throughout the cross-section. The process of making air rich fabric is also described. The process basically comprises the following steps:

a) Blending water soluble material slivers with the base material slivers in the draw frame to obtain blended slivers;

b) Drawing the blended slivers obtained in step (a) till homogeneously blended strands are obtained;

c) Pre spinning the homogeneously blended strand obtained in step (b) to obtain well blended roving;

d) Spinning the well blended roving obtained in step (c) to obtain yarns;

e) Weaving or knitting fabric using yarns obtained in step (d) as at least one of the component;

f) Treating the fabric obtained in step (e) with water to dissolve out water soluble component to obtain fabric with pores;

g) Optionally Dying the fabric obtained in step (f) to obtain dyed fabric; and h) Optionally Post treating dyed fabric obtained in step (g).

The fabric is washed in warm water to dissolve the water soluble fibers. The amount of fibers dissolved, depends upon the count of the yarn or yarns used. The amount of water soluble fibers present can vary from about 8% to about 25% of the weight of the yarn. For example, water soluble fiber may be present as 8%, 10%, 12%, 14%, 15%, 16%, 18%, 20%, 22%, or 24% of the weight of the yarn. By dissolving the water soluble fibers, additional air spaces are produced on the structure of yarn, corresponding to an increase in the airspace in the yarn. By increasing the through pores in the yarn, the resulting fabric (e.g. towel) is softer and bulkier than standard cotton fabric (e.g. cotton towel) having good water permeability and drying properties.

The terry fabrics and yarns of the present invention can absorb, for example, between about 75% and 100% of the water contacting the yarn or fabric (Amount of water as per Test Method ASTM D4772). In a preferred embodiment, the air rich yarns and towel fabrics of the present invention can absorb between about 75% and 100% of the water contacting the yarn or towel fabric. In another embodiment the air rich fabrics can absorb more than 75% of the water contacting the yarn or fabric and dried at a rate 10 to 30% faster than the normal yarn or fabric. In yet another embodiment the porous yarns and fabrics are 30 to 40% more voluminous than the normal and have 20 to 30% higher thermal insulation properties.

The air rich yarn herein described typically contains base material fibers and a fiber, which dissolves in warm water i.e. water soluble fibers, such as PVA (Polyvinyl Alcohol).

The air rich yarn is used in the pile of the towel or toweling fabric. Whereas in the case of a flat fabric, such as sheeting, warp and/or weft yarn can be air rich yarn.

Air rich pile yarn is woven with base material weft and warp yarns to produce terry fabrics, such as towels. The fabric is then washed in warm water to dissolve water soluble fibers. The amount of water soluble material present can vary from about 8% to about 25% of the weight of the yarn. For example, the PVA may be present as 8%, 10%, 12%, 14%, 15%, 16%, 18%, 20%, 22%, or 24% of the weight of the yarn. By dissolving the water soluble fibers, additional air spaces are produced on the structure of pile yarn, corresponding to an increase in the airspace in the pile yarn. By increasing the through pores in the pile yarn, the resulting towels are softer and bulkier than standard cotton towels having good wettability and drying properties.

In the case of flat fabrics the air rich warp and/or weft yarn similarly contain warm-water soluble fibers, such as polyvinyl alcohol (PVA) fibers, in the structure of the cotton yarn and/or other fibers as base material.

The cotton that may form the major component of surface of the pile yarn or warp-weft yarn can be of any origin; for example, Indian, Egyptian, Australian, United States of America (USA), Syria, or Russia.

The water soluble fiber used can be PVA. The properties of fibers available for manufacture of spun PVA yarn are given below in table 1.

TABLE 1

Properties of cut staple fibers available for manufacture of spun PVA yarn.

| S. No. | Nominal Dissolving Temp in Water (Lowest Temp) (degree Celsius) | Fineness (dtex) | Cut length (mm) B = variable cut length | Tenacity (cN/dtex) | Elongation (%) |
|---|---|---|---|---|---|
| 1 | 40 | 1.2 | 38 | 7.1 | 15.4 |
| | | 1.7 | 38 | | |
| | | 2.2 | 38, 51, | | |
| 2 | 50 | 1.7 | 32, 38 | 7.1 | 15.1 |
| | | 2.2 | 32, 38, 51, | | |
| 3 | 70 | 1.7 | 38 | 7.2 | 12.1 |
| | | 2.2 | 51 | | |
| 4 | 80/90 | 1.4 | 32, 38 | 7.6 | 11.1 |
| | | 1.7 | 32, 38 | | |
| | | 2.2 | 51, | | |
| | | 2.2 | | 7.6 | 15.1 |
| 5 | 95 | 1.7 | 38 | 7.5 | 10.1 |
| | | 2.2 | 51, | | |

Figure 2:
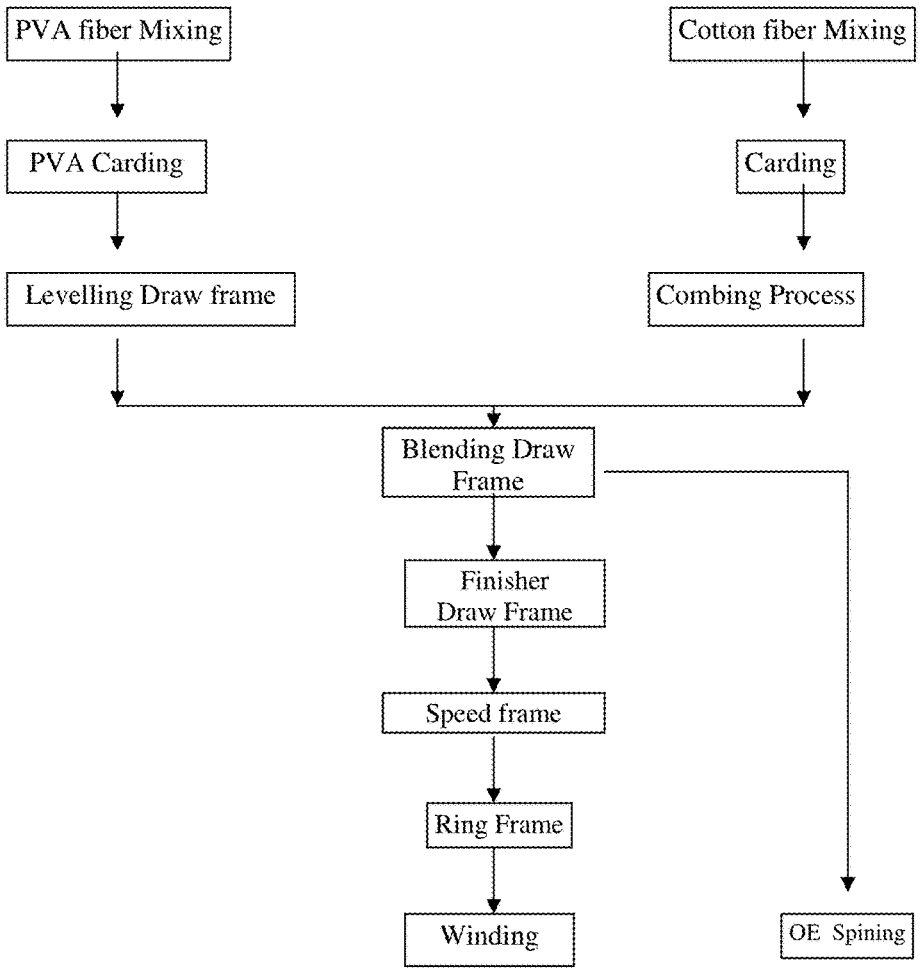
FIG. 2 illustrates a process Sequence for manufacturing Air Rich Yarn
Figure 3:
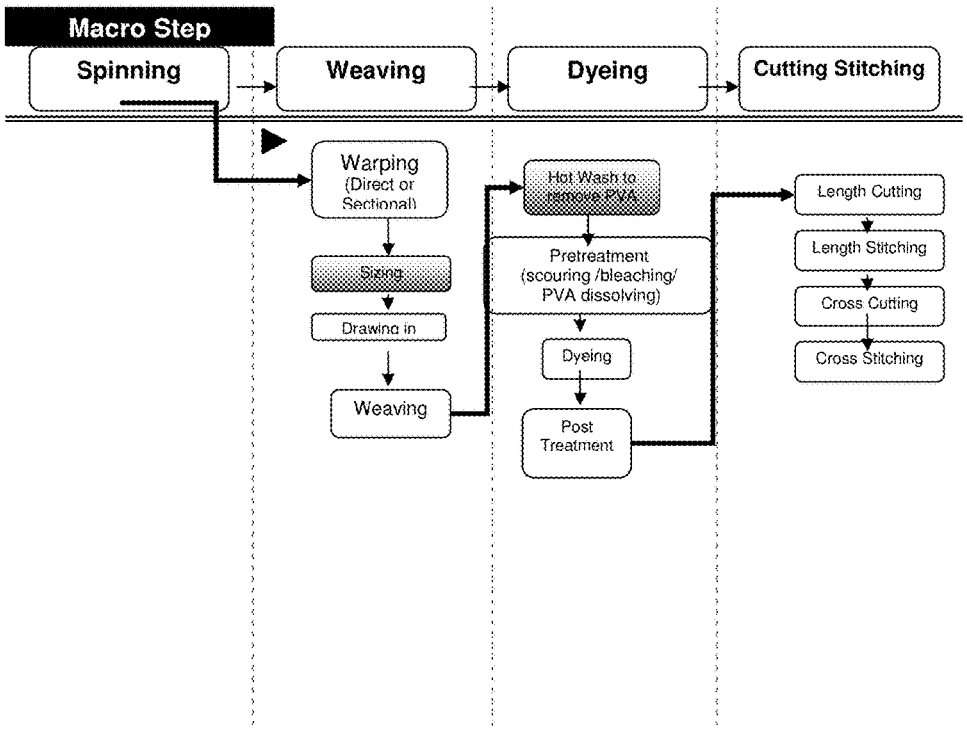
FIG. 3 illustrates an Air Rich-Toweling Fabric manufacturing process steps. Diversions show alternative path in spinning section for Ring Spinning and Open End spinning. Shaded Blocks are optional processes.

In specific embodiments: The process of manufacturing air rich fabric comprises the following steps and can be understood with reference to FIG. 2 and FIG. 3:

Producing Water Soluble Material Slivers from Water Soluble Fibers—

The water soluble material fibers (e.g. PVA fibers) are first processed through a blow room in the cotton spinning system. In spinning process the fibers are made into slivers through the process of carding and use of a draw frame (one or two passages as required in order to ensure uniformity of fibers in the stream). The range of water soluble material sliver hank is from 0.05 to 0.40s Ne.

A water soluble material fiber sliver is made on the draw frame with a finer hank greater than or equal to 0.05 hank. The denier of the water soluble material fibers is typically from about 0.9 to about 2.2 denier. It can have a cut length that is equal to or more than 32 mm and equal to or shorter than 51 mm (44 mm and 51 mm fiber can be used with modifications in the machine parameters in spinning).

Producing Base Material Slivers from Base Material Fibers

The base material sliver may be made from, for example, different cotton blends, silk fibers, modal fibers, acrylic fibers; blends of cotton and bamboo; blends of cotton and sea weed fibers; blends of cotton and sliver fibers; and blends of cotton & charcoal fibers. The warp-weft yarn in flat fabrics may have blends of, for example, polyester and cotton; blends of polyester & viscose; blends of cotton and modal; blends of cotton and silk and modal; blends of cotton and bamboo; blends of cotton and sea weed fibers; blends of cotton and silver fibers; blends of cotton and charcoal fibers, and any combinations thereof. In case of blended sliver, each component is separately processed through carding/combing and the individual carded slivers are subsequently blended together on draw frames.

The cotton sliver is prepared by processing through the blow room, carding, draw frame, combers, and final draw frames, producing a 0.05 hank sliver and above.

After carding, the cotton sliver is subjected to combing to remove short fibers. The amount of noil, or fibers that are less than 12 mm, removed, ranges from 7% to 24% of the weight of the feed material. For example, the weight removed can be 8%, 10%, 12%, 15%, 16%, 18%, 20%, 22%, and 24% of the weight of the feed material.

Blending Water Soluble Material Slivers with the Base Material Slivers

It involves blending water soluble material slivers with base material slivers in the draw frame of a cotton spinning system. Further, giving one or more draw frame passages for achieving the blending homogeneity in radial direction is the ideal method of achieving through pores on the surface of the final yarn and making the porous yarn structure in final fabric because water soluble fibres are uniformly distributed in the structure of the yarn. This is quite different from the normal "PVA based absorbent" yarn where PVA fibres are their in the core of the yarn and goes off only from the core in final finishing stage making core hollow with so called closed or blind pores not the whole structure porous with through pores.

Pre Spinning the Homogeneously Blended Strand

It involves drawing the homogeneously blended strand to roving form and making a twisted roving on speed frame. In conventional terminology this process step is termed as pre spinning which prepares the material for the final yarn spinning.

The twisting of the roving with the PVA fibers in the structure is done in the normal fashion, i.e. with clockwise rotation of the flyer to give 'Z' twist. Alternatively, the roving can have 'S' twist, by reversing the direction of the rotation of the flyer to a counter-clockwise direction.

The roving produced by these methods has a twist multiplier to optimize the working conditions. The roving hank ranges from about 0.5 to about 3.0 hanks.

Spinning the Well Blended Roving

The Air rich yarn is spun on the ringframes using the preferred blend settings, for example, all of the setting parameters on ringframe are determined based on the type of water soluble material and other base materials used to make the yarn. The yarn spun on the Ring Spinning has a count ranging from about Ne 7s to about 32s for terry fabrics and about Ne.10s to about 100s for flat fabrics. Where doubled yarn is to be made, two single yarns are doubled on two-for-one twisters with a TPI (twists per inch) from about 5.5 to about 16.5 TPI in 'S' direction. The twist direction can be Z over S or Z over Z. The resultant counts would be about 2/7s to about 2/32s, for terry fabrics. Similarly the doubled yarns for flat fabrics may be from about 10/2s to about 100/2s with about 50% to about 85% of single yarn TPI as doubled yarn TPI in either Z over S or Z over Z configuration. The cut length of the water soluble material (PVA) fibers is about 32 mm, 38 mm and 44 mm (with longer middle cradle in the drafting zone) which can be used for spinning in the cotton system. The machinery settings depend on the fiber length and the settings will be as per the recommendation of the machine manufacturer for these lengths. For the coarser count the same water soluble material (PVA) blended sliver can be used on OE spinning system to make the porous yarn for towel, rugs and carpet fabric. OE stands for Open End (OE) spinning, a different spinning technique of making yarn other than the ring spun yarn, where in the yarn is made directly from sliver by using rotor-spinning technology.

The processing parameters depend on the water soluble material fiber and base material used and/or other fibers used in the blend. The ring spun yarn is wound into large packages on the Autoconer using suitable settings and process parameters Weaving or Knitting the Yarns to Obtain Fabric A) Terry Fabric Woven Terry fabrics (e.g. terry towels) are formed from three types of yarns: 1) Ground Warp 2) Weft 3) Pile Warp. The first type of yarn is the ground warp. The ground warp is the longitudinal set of yarn forming the base for fabric. The second type of yarn is weft yarn. Weft yarn is perpendicular to ground yarn and interlace with ground yarn to make a base fabric. Ground and Weft yarn form a base fabric in which third type of yarn pile is hold in the form of loops. These loops are protruding outward and contributing to thickness and bulk of fabric. These yarn are meant for absorbing water from surface e.g. when used during bath.

The Ground yarn has a single or double count. Double count range from about Ne 2/12s to about Ne 2/30s and single count from about Ne10s to about Ne 16s combed or carded. Yarn can be made using any spinning technique e.g ring spinning, open end spinning etc. In the preferred embodiment, the ground yarn is about 2/20s carded ring spun.

The weft yarn, has a count ranging from about Ne 7s to about Ne 30s generally both carded/combed made with any spinning technique e.g Ring Spinning, Open End Spinning etc. In the prescribed embodiment the weft is about Ne16s carded ring spun yarn.

The Pile yarn has a single or double count. Double count range from about Ne 2/16s to about Ne 2/30s and single count from about Ne 7s to about Ne 32s combed or carded. Yarn can be made using any spinning technique e.g ring spinning, open end spinning etc. In the preferred embodiment, the pile yarn is about 13s Combed ring-spun made with Air Rich Technique and comprises water soluble material fibers.

The Twist Multiplier for weft yarn and ground yarn is from about 3.4 to about 5.4 Z twist generally depending upon fiber and spinning technique.

The ground, weft, and pile yarns are woven together. The terry fabric is generally made on 56s, 60s and 70s reeds; however, reed is not a limiting factor.

The terry weave can be 3 pick terry, 4 pick terry, 5 pick terry, 6 pick terry. The pile height can range from about 2.5 mm to 10 mm. Most common is 4 mm to 6.5 mm.

B) Flat Fabric

Flat fabrics are woven with air rich warp and/or air rich weft yarn. The fabric construction depends on the end use and type of fabric to be made.

Treating the Fabric with Water

Water soluble Fibers (PVA fibers) are dissolved out during dyeing or before dyeing at temperature depending upon the type of water soluble material used. However, the temperature for dissolving PVA fibers ranges from 40 Deg C. to 110 Deg C. depending on type of PVA fiber, dyeing machine, liquor ratio and cycle time.

The liquor ratio is a ratio of the material weight (Fabric) to water (Volume). The liquor ratio should be sufficient to facilitate prompt dissolution of the PVA, while allowing free movement of the fabric. The liquor ratio ranges from about 1:4 to about 1:30. For example, the liquor ratio may be 1:7, 1:12, 1:15, 1:20, 1:25, 1:22, or 1:28. This depends on dyeing machines technology/setup available. In the preferred embodiment the liquor ratio is 1:4.5 which is considered as lowest in exhaust batch dyeing process in soft flow machines. In general liquor ratio used 1:7 in soft flow exhaust batch dyeing machines. In case dyeing is carried out in winch or Jigger machines material to liquor ratio is as high as 1:20

In order to make air rich product, water soluble fiber has to be removed completely. The product Quality is independent of liquor ratio.

In another embodiment, after washing, the liquor is drained and fresh water is injected for rinsing to eliminate all the dissolved PVA. The water is at a temperature ranging from about 55 degree Celsius to about 100 degree Celsius. Preferably, the water is at a higher temperature, such as 100 degree Celsius. Therefore, the fabric is rinsed in hot water after draining to wash away any PVA residue. This rinsing step also ensures that any loose fibers drain out along with the drain water.

Dying & Post Treatment

After dissolving the water soluble material the fabric is dyed with normal dyeing process which is scoured, bleached and dyed in the normal fashion in a fabric dying machine. While scouring, bleaching and dyeing, the operating temperature ranges from about 60 degree Celsius to about 110 degree Celsius. However, temperature for dissolving PVA ranges from 50 Deg C. to 100 Deg C. depending on type of PVA fiber.

The liquor ratio is a ratio of the material weight (Fabric) to water (Volume). The liquor ratio should be sufficient to facilitate prompt dissolution of the PVA, while allowing free movement of the fabric. The liquor ratio ranges from about 1:4 to about 1:30. For example, the liquor ratio may be 1:7, 1:12, 1:15, 1:20, 1:25, 1:22, or 1:28. In the preferred embodiment the liquor ratio is 1:4.5

Air rich product quality is not dependent on dyeing process. If PVA or other water soluble fiber is removed properly during or before dyeing the yarn and thus the product becomes Air Rich and improved properties i.e better wettability, higher thickness, faster drying, better absorbency are achieved.

After washing, the liquor is drained and fresh water is injected for rinsing to eliminate all the dissolved PVA. The water is at a temperature ranging from about 55 degree Celsius to about 100 degree Celsius. Preferably, the water is at a high temperature, such as 100 degree Celsius. The PVA coagulates during the dissolving step and promptly dissolves in hot water if the high temperature is not maintained. Therefore, the fabric is rinsed in hot water after draining to wash away any PVA residue. This rinsing step also ensures that any loose fibers drain out along with the drain water.

After dyeing or washing fabric has to be dried. There are several ways for drying the fabric. In present embodiment, drying is done through hydro extractor, rope opener, loop dryer and stenter. Gradual drying leads to better hand feel.

The method of processing can also be continuous bleaching and continuous dyeing range followed by hot air drying and stentering. Care is to be exercised to ensure that the PVA dissolves completely, during the process.

EXAMPLES

The following example illustrates typical pile yarn manufacturing parameters, towel manufacturing parameters, and processing details.

Example 1: Pile Yarn Manufacturing, Towel Manufacturing, and Processing

The PVA fiber used in this example is 1.4 denier 38 mm fiber and S6 cotton of Indian origin with 2.5% span length of 28 to 32 mm, micronaire of 3.9 to 4.9, fibre strength of 28 Gtex to 30 Gtex, and short fibre index 3.5 to 6.5%. The cotton and PVA fibers were blended to produce a pile yarn containing 85% J 34 Combed Sliver (18% Noil) and 15% PVA (1.4 denier).

The spinning process parameters and yarn properties for PVA/Cotton Pile Yarn are described below.

Cotton Sliver Preparation

The cotton used for the preferred embodiment of Ne 13's is S 6 having the following parameters:

TABLE 2

| Parameters of cotton used | |
|---|---|
| 2.5% span length | 28 to 32 mm |
| Micronaire (μg/inch) | 3.9 to 4.9 |
| Fibre Strength (gm/tex) | 27 to 31 gm/tex |
| Short fibre index | 3.5 to 6.5% |

The cotton is processed through blowroom having bale plucker, vario clean, unimix, and ERM beater.

The cotton is processed from blowroom through to carding where the fibers are individualized. The hank of the card sliver is maintained at 0.1 delivered from machine at speed of 145 meter/minute.

The cotton sliver from carding is then processed through a beaker drawing where at the feed end the number of doublings are 6 and a hank delivered kept at 0.12. The delivery speed is 450 mtrs per minute.

Since combing is necessary to remove short fibers, the drawframe slivers are processed through unilap machine with 24 doublings and formed into a lap of 75 gms/meter at a delivery speed of 120 meters/min.

The lap is processed on combing machine with 8 heads and one delivery resulting in a hank of 0.10. The combers worked at 350 nips/min with a backward feed of 5.2 mm per nip. The extracted noil is 18%.

PVA Sliver Preparation

The PVA fiber used is 38 mm*1.4 denier. The PVA fibers are first passed through blowroom having a feeder and a MBO beater only. This is because the PVA fiber is the manmade fiber and is clean without any impurities.

The PVA fibers from Blow Room goes to the carding machine where the cards are run at 100 meters/minute delivery speed and a hank of 0.12. On the card the flat speeds are kept low at 90 to 110 mm per minute to minimize wastage.

The card sliver (PVA) is then processed through leveling drawframe, with 6 ends up and a delivery hank of 0.11. The machine runs at 300 meter/minute.

Blending on Draw Frame

A blending passage drawing with 5 ends up of combed cotton sliver and one leveled sliver was doubled at 200 meters/min speed a delivery hank of 0.11 is given for mixing and making the fibers more parallel with one another.

During the feeding of slivers in blending draw frame the PVA sliver remains in the centre of the cotton slivers 8 blended sliver is again doubled and drafted on the finisher draw frame for making the resultant sliver which is having uniform transverse and longitudinal blend of cotton and PVA fibre. The hank of delivered sliver was 0.11s Ne and delivered through autolevelled (for insuring the mixing of two components in the final sliver) draw frame at a speed of 250 meter/min)

The fibres in the delivered sliver are parallel, straightened and well mixed across the radial and longitudinal direction The Finisher Draw Frame PVA and cotton blended sliver cans are kept at the feed end of the speed frame and a roving of 0.5 hank is delivered after drafting and twisting of feed sliver. The hank of roving delivered was 0.5s Ne.

The following table enumerates the properties of the preferred embodiment Ne 13s Air rich yarn with PVA/cotton in the structure.

TABLE 3

| Properties of Air rich yarn | |
|---|---|
| Average Count | 13.0s NE |
| Average lea strength lbs | 208 |
| CSP (count strength product) | 2650 |
| Count CV % | 1.2 |
| Strength CV % | 6.5 |
| Average TPI | 12.9 |
| Average U % (percent mean deviation) | 8. |
| Thin Places/km (−50%) | 0.1 |
| Thick places/km (+50%) | 8.9 |
| Neps/km (+200%) | 9.0 |
| Total Imperfection per km | 17.9 |

TABLE 3-continued

| Properties of Air rich yarn | |
|---|---|
| Hairiness Index | 9.32 |
| Average Breaking force (gms) | 634 |
| Average Rkm (cN/Tex) | 15.77 |
| RKM CV % | 9.60 |
| Elongation at Break % | 5.81 |
| Elongation CV % | 9.31 |

Spinning

The well blended roving so produced on the speed frame is then spun into yarn on the cotton ring spinning frame. In the preferred embodiment Ne 13s the roving of 0.50 hank is drafted 26 times on the drafting system of ring frame and spun into yarn with 13.9 TPI. The machine is generally run at 7000 to 18000 rpm. In the preferred embodiment the speed is 11000 rpm. The yarn from ring frame bobbins is cleared and wound into large packages at autoconer.

Fabric Manufacturing

The specifications kept for manufacturing the Air rich fabric is given in the table below:

TABLE 4

Specification for manufacturing air rich fabric.

| | Finished Towel | | Grey Towel | |
|---|---|---|---|---|
| Towel Specification | Width (cm) | Length (cm) | Width (cm) | Length (cm) |
| Dimension W × L CM | 76.2 | 137.16 | 87.66 | 147.43 |
| G.S.M | 506.33 | | na | |
| Wt. Loss % Grey To Finish | 17 | | na | |
| Wt. Loss % Dyeing | 17 | | na | |
| Wt. Of Towel Gms | 529.1955 | | 637.5849 | |
| Shrinkage in Width % R.S. to Finish | 13.29 | | na | |
| Shrinkage in Length % Grey to Finish | 3 | | na | |
| Plain Portion in Width (cm) | 1.6 | | 5.5 | |
| Terry Portion in Width (cm) | 74.6 | | 82.16 | |
| Plain Portion in Length (cm) | 0 | | 2.4 | |
| Crammed Hem Portion in Length (cm) | 3 | | 7 | |
| Border Portion in Length (cm) | 5.08 | | 5.08 | |
| Terry Portion in Length (cm) | 129.08 (0.000 + 0.000) | | 132.95 | |
| Pile Density/DM of Finished Towel | 3560.07 | | | |
| On Loom Specification | | | | |
| RS For Terry Cm | 86.03 | RS For Towel Cm | 91.79 | |
| Reed (Ends/Cm) | 11.81 | Picks/Cm (Terry) | 15.5 | |
| Pile Ratio in Terry | 6.53 | Pile Height MM | 6.32 | |
| Avg. Picks/Cm Fin. | 17.85 | Type of Terry | 3pick | |
| Warp Specification | Pile Warp | Ground Warp | | |
| Warp Count | 12 | 10 | | |
| No. OF Ends/Towel | 1,016.00 | 1,152.00 | | |
| Size % | 0.75 | 0 | | |
| False Selvedge Ends | 0 | 32 | | |
| No. OF Ends/Beam | 3,048 | 3,488 | | |
| Warp Length/Towel CM | 883.9436 | 158.4873 | | |
| Weft Specification | | | | |
| Material | Picks | TM (1 ply)/TPI (2ply) | | |
| YG10OW1C00 | 144 | 5.4 | | |
| YG16KF1C00 | 1,942 | 4.3 | | |
| YG20CW2SM399999999 | 362 | 10.5 | | |

The towels with air rich yarn in the pile and cotton yarn in weft and ground is processed in the dyeing house in the rope form. The dyeing process comprises of dissolving PVA followed by normal cotton dyeing process (if base material is cotton). PVA dissolving is done at 100 deg C. for 10 min in soft flow machines. The water is drained and pretreatment is started. Pretreatment comprises of bleaching and scouring. It is done in one step using caustic lye and hydrogen peroxide. Dyeing is as the standard cotton dyeing process for reactive dyeing. After dyeing, softeners are added in acetic medium in order to regain softness of the cotton fiber. Softeners used in terry toweling are silicon based, hydrophilic so that absorbency due to softener does not reduce.

Examples 2 to 7 provide the process parameters of processes used for manufacturing air rich yarns using various base materials and water soluble materials. Table 5 below provides brief descriptions of the said processes.

TABLE 5

Description of processes used in manufacture of air rich yarns

| Name of Process | Description of Process | Objective of Process |
|---|---|---|
| Blow Room | Set of M/c with cylinders with spikes/wire points in gradual decrement in size and increment in Nos | Opening of fiber into small tufts and simultaneous cleaning |
| Carding | M/c with very fine wire points on cylinders | Individualization of fibers, Fine Cleaning and Removal of fiber entanglements (Neps). |
| Levelling/ Breaker | M/c have Three Pair of Rolls to Draw Sliver | Making Sliver of Uniform thickness and Parallelizing fibers |
| Unilap | Slivers from Breaker laid beside one another and wound in form of Sheet(Lap) | To make suitable package form(Lap) for Combing |
| Comber | Stationary and Revolving comb to comb cotton Fleece | Removal of Short fibers and Neps from Cotton and converting Lap into Sliver |
| Finisher/ Blender | M/c have Three Pair of Rolls to Draw Sliver and Autolevelling of Delivered Sliver | Uniform sliver Wt/Unit length with increased Parallelization |
| Simplex | Set of Rolls for drawing sliver to form Roving and Winding on Bobbins | To form suitable package size to feed material in Ring Farme |
| Ring Frame | Set of Rolls to Draw Roving and Twisting mechanism to give strength. | Final Yarn Conversion |
| Winding | Electronic Clearer to remove faults and Splicer to join Yarn ends | Yarn is wound on cones as package wt required by customer and ensured all objectionable faults are Removed |

TABLE 6

The following table shows Process Parameters for manufacturing of Air Rich Yarn using PVA and J34 Cotton fiber.

| Sr No. | Fibre Parameters | Count 12 Cw Air rich (PVA/J34 Cotton) | |
|---|---|---|---|
| | Fibre denier | 1.2 Denier | |
| | Fibre Length | 38 mm | |
| | Fibre Upper half mean length | | 28.85 |
| | Micronaire | | 4.59 |
| | Fibre strength (gm/tex) | | 31.23 |
| 1 | Blowroom | PVA | Cotton |
| | Mixing | 100% PVA | 100% S 6 |
| | MBO Beater 1 Speed | 450 rpm | 450 rpm |
| | MBO Beater 2 Speed | 650 rpm | 650 rpm |
| | Vario Clean | | 650 rpm |
| | Unimix | | 500 rpm |
| | ERM | | 550 rpm |
| 2 | Carding | | |
| | Speed | 100 m/min | 150 m/min |
| | Cylinder Speed | 450 | 500 |
| | Licker In Speed | 650 | 950 |
| | Flat Speed | 7.5 inch/min | |
| | Flat Gauge | 12, 12, 16, 16, 16 | 12, 12, 10, 10, 10 |
| | Output Hank | 0.1 | 0.12 |
| 3 | Levelling/Breaker | RSB (levelling). | DO/6 |
| | Break Draft | 1.16 | 1.7 |
| | Roll Gauge | 46/50 | 40/44 |
| | Speed | 400 | 350 |
| | Doubling | 6 | 8 |
| | Input Hank | 0.1 | 0.12 |
| | Output Hank | 0.103 | 0.12 |
| 4 | Unilap (only for Cotton) | Not Applicable For PVA | LH 10 |
| | Speed | | 110 |
| | Break Draft | | 1.02 |
| | Doubling | | 22 |
| | Lap Hank | | 76 gm/mtr |
| 5 | Comber (only for Cotton) | Not Applicable For PVA | |
| | Nips/Min | | 350 |
| | Feed/Nip | | 4.7 mm |
| | Noil | | 16.50% |
| | Output Hank | | 0.11 |
| 6 | Finisher/Blender | RSB (Blending) | |
| | Break Draft | 1.16 | |
| | Speed | 450 m/min | |
| | Doubling | 6 cotton/1 PVA (PVA in Center) | |
| | Output Hank | 0.11 | |
| 7 | Simplex | | |
| | Rov Hank | 0.55 | |
| | Speed | 850 | |
| | Spacer | 9 mm | |
| | TM | 1.25 | |
| 8 | Ringframe | | |
| | Speed | 11600 | |
| | TM | 3.5 | |
| | Spacer | 4.5 | |
| | Break Draft | 1.2 | |
| | Yarn Count (English System) | 12s Ne | |
| 9 | Winding | | |
| | Winding Speed | 1300 m/min | |
| | Cone Weight | 2.52 kg | |

Example 2: Air Rich Yarn Made Using J34 Cotton

Process parameters for manufacturing air rich yarn using PVA as water soluble material and J 34 cotton as base material are provided in table 6 below. Parameters include all machine settings, Speed & Waste level of Blowroom, Carding, Draw Frame, Unilap, Comber, Simplex, Ring frame, Winding for spinning of PVA and J34 Cotton fiber

Example 3: Air Rich Yarn Made Using J34 Cotton

Process parameters for manufacturing air rich yarn using PVA as water soluble material and PIMA cotton as base material are provided in table 7 below. Parameters include all machine settings, Speed & Waste level of Blowroom, Carding, Draw Frame, Unilap, Comber, Simplex, Ring frame, Winding for spinning of PVA and PIMA Cotton fiber.

TABLE 7

The following table shows Process Parameters for manufacturing of Air Rich Yarn using PVA and PIMA Cotton fiber.

| Sr No. | Fibre Parameters | Count 12 Cw Air rich (PVA/ PIMA Cotton) | |
|---|---|---|---|
| | Fibre denier | 1.2 Denier | |
| | Fibre Length | 38 mm | PIMA |
| | Fibre Upper half mean length | | 34.25 |
| | Micronaire | | 4.22 |
| | Fibre strength (gm/tex) | | 38.87 |
| 1 | Blowroom | PVA | |
| | Mixing | 100% PVA | 100% PIMA |
| | MBO Beater 1 Speed | 450 rpm | |
| | MBO Beater 2 Speed | 650 rpm | |
| | Vario Clean | | 650 rpm |
| | Unimix | | 500 rpm |
| | ERM | | 550 rpm |
| 2 | Carding | | |
| | Speed | 100 m/min | 150 m/min |
| | Cylinder Speed | 450 | 500 |
| | Licker In Speed | 650 | 950 |
| | Flat Speed | 7.5 inch/min | |
| | Flat Gauge | 12, 12, 16, 16, 16 | 12, 12, 10, 10, 10 |
| | Output Hank | 0.1 | 0.12 |
| 3 | Levelling/Breaker | RSB (levelling). | DO/6 |
| | Break Draft | 1.16 | 1.7 |
| | Roll Gauge | 46/50 | 38/42 |
| | Speed | 400 | 350 |
| | Doubling | 6 | 8 |
| | Input Hank | 0.1 | 0.12 |
| | Output Hank | 0.103 | 0.12 |
| 4 | Unilap (only for Cotton) | Not Applicable For PVA | E30 |
| | Speed | | 120 |
| | Break Draft | | 1.02 |
| | Doubling | | 20 |
| | Lap Hank | | 74 gm/mtr |
| 5 | Comber (only for Cotton) | Not Applicable For PVA | |
| | Nips/Min | | 350 |
| | Feed/Nip | | 5.2 mm |
| | Noil | | 15.50% |
| | Output Hank | | 0.12 |
| 6 | Finisher/Blender | RSB (Blending) | |
| | Break Draft | 1.16 | |
| | Speed | 450 m/min | |
| | Doubling | 6 cotton/1 PVA (PVA in Center) | |
| | Output Hank | 5.36 | |
| 7 | Simplex | | |
| | Rov Hank | 0.55 | |
| | Speed | 850 | |
| | Spacer | 9 mm | |
| | TM | 1.25 | |
| 8 | Ringframe | | |
| | Speed | 11600 | |
| | TM | 3.4 | |
| | Spacer | 4.5 | |
| | Break Draft | 1.2 | |
| | Yarn Count (English System) | 13s Ne | |
| 9 | Winding | | |
| | Winding Speed | 1300 m/min | |
| | Cone Weight | 2.52 kg | |

Example 4: Air Rich Yarn Made Using S6 Cotton Blend with Sorona Fiber from Dupont Process parameters for manufacturing air rich yarn using PVA as water soluble material and blend of S 6 Cotton/ Sarona as base material are provided in table 8 below. Parameters include all machine settings, Speed & Waste level of Blowroom, Carding, Draw Frame, Unilap, Comber, Simplex, Ring frame, Winding for spinning of PVA and Sarona/Cotton fiber.

TABLE 8

The following table shows Process Parameters for manufacturing of Air Rich Yarn using PVA and Sarona/Cotton fiber.

| Sr No. | Fibre Parameters | Count Cw Air rich (PVA/S 6 Cotton/Sorona) | Sorona |
|---|---|---|---|
| | Fibre denier | 1.2 Denier | 1.45 Denier |
| | Fibre Length | 38 mm | 38 MM S-6 |
| | Fibre Upper half mean length | | 28.85 |
| | Micronaire | | 4.59 |
| | Fibre strength (gm/tex) | | 31.23 |
| 1 | Blowroom | PVA | |
| | Mixing | 100% PVA | 85% combed S6 Sliver + 15% Sorona |
| | MBO Beater 1 Speed | 450 rpm | |
| | MBO Beater 2 Speed | 650 rpm | |
| | Vario Clean | | 650 rpm |
| | Unimix | | 500 rpm |
| | ERM | | 550 rpm |
| 2 | Carding | | |
| | Speed | 100 m/min | 120 m/min |
| | Cylinder Speed | 450 | 500 |
| | Licker In Speed | 650 | 950 |
| | Flat Speed | 7.5 inch/min | |
| | Flat Gauge | 12, 12, 16, 16, 16 10, 10 | 12, 12, 10, |
| | Output Hank | 0.1 | 0.12 |
| 3 | Levelling/Breaker | RSB (levelling). | DO/6 |
| | Break Draft | 1.16 | 1.7 |
| | Roll Gauge | 46/50 | 38/42 |
| | Speed | 400 | 350 |
| | Doubling | 6 | 8 |
| | Input Hank | 0.1 | 0.12 |
| | Output Hank | 0.103 | 0.12 |
| 4 | Unilap (only for Cotton) | Not Applicable For PVA | E30 |
| | Speed | | 120 |
| | Break Draft | | 1.02 |
| | Doubling | | 20 |
| | Lap Hank | | 74 gm/mtr |
| 5 | Comber (only for Cotton) | Not Applicable For PVA | |
| | Nips/Min | | 350 |
| | Feed/Nip | | 5.2 mm |
| | Noil | | 15.50% |
| | Output Hank | | 0.12 |
| 6 | Finisher/Blender | RSB (Blending) | |
| | Break Draft | 1.16 | |
| | Speed | 450 m/min | |
| | Doubling | 6 cotton/1 PVA (PVA in Center) | |
| | Output Hank | 5.36 | |
| 7 | Simplex | | |
| | Rov Hank | 0.55 | |
| | Speed | 850 | |
| | Spacer | 9 mm | |
| | TM | 1.25 | |
| 8 | Ringframe | | |
| | Speed | 11600 | |
| | TM | 3.9 | |
| | Spacer | 4.5 | |
| | Break Draft | 1.2 | |
| | Yarn Count (English System) | 12 s Ne | |
| 9 | Winding | | |
| | Winding Speed | 1300 m/min | |
| | Cone Weight | 2.52 kg | |

Example 5: Air Rich Yarn Made Using S6 Cotton

Process parameters for manufacturing air rich yarn using PVA as water soluble material and S 6 Cotton as base material are provided in table 9 below. Parameters include all machine settings, Speed & Waste level of Blowroom, Carding, Draw Frame, Unilap, Comber, Simplex, Ring frame, Winding for spinning of PVA and S6 Cotton fiber.

TABLE 9

The following table shows Process Parameters for manufacturing of Air Rich Yarn using PVA and S6 Cotton fiber.

| Sr No. | Fibre Parameters | Count 12 Cw Air rich (PVA/S 6 Cotton) | |
|---|---|---|---|
| | Fibre denier | 1.2 Denier | |
| | Fibre Length | 38 mm | |
| | Fibre Upper half mean length | | 30.28 |
| | Micronaire | | 4.25 |
| | Fibre strength (gm/tex) | | 32.18 |
| 1 | Blowroom | PVA | |
| | Mixing | 100% PVA | 100% S6 |
| | MBO Beater 1 Speed | 450 rpm | |
| | MBO Beater 2 Speed | 650 rpm | |
| | Vario Clean | | 650 rpm |
| | Unimix | | 500 rpm |
| | ERM | | 550 rpm |
| 2 | Carding | | |
| | Speed | 100 m/min | 150 m/min |
| | Cylinder Speed | 450 | 500 |
| | Licker In Speed | 650 | 950 |
| | Flat Speed | 7.5 inch/min | |
| | Flat Gauge | 12, 12, 16, 16, 16 | 12, 12, 10, 10, 10 |
| | Output Hank | 0.1 | 0.12 |
| 3 | Levelling/Breaker | RSB (levelling). | DO/6 |
| | Break Draft | 1.16 | 1.7 |
| | Roll Gauge | 46/50 | 38/42 |
| | Speed | 400 | 350 |
| | Doubling | 6 | 8 |
| | Input Hank | 0.1 | 0.12 |
| | Output Hank | 0.103 | 0.12 |
| 4 | Unilap (only for Cotton) | Not Applicable For PVA | E30 |
| | Speed | | 120 |
| | Break Draft | | 1.02 |
| | Doubling | | 20 |
| | Lap Hank | | 74 gm/mtr |
| 5 | Comber (only for Cotton) | Not Applicable For PVA | |
| | Nips/Min | | 350 |
| | Feed/Nip | | 5.2 mm |
| | Noil | | 15.50% |
| | Output Hank | | 0.12 |
| 6 | Finisher/Blender | RSB (Blending) | |
| | Break Draft | 1.16 | |
| | Speed | 450 m/min | |
| | Doubling | 6 cotton/1 PVA (PVA in Center) | |
| | Output Hank | 5.36 | |
| 7 | Simplex | | |
| | Rov Hank | 0.55 | |
| | Speed | 850 | |
| | Spacer | 9 mm | |
| | TM | 1.25 | |
| 8 | Ringframe | | |
| | Speed | 11600 | |
| | TM | 3.5 | |
| | Spacer | 4.5 | |
| | Break Draft | 1.2 | |
| | Yarn Count (English System) | 12s Ne | |
| 9 | Winding | | |
| | Winding Speed | 1300 m/min | |
| | Cone Weight | 2.52 kg | |

Example 6: Air Rich Yarn Made Using MCU5 Cotton

Process parameters for manufacturing air rich yarn using PVA as water soluble material and MCU 5 cotton as base material are provided in table 10 below. Parameters include all machine settings, Speed & Waste level of Blowroom, Carding, Draw Frame, Unilap, Comber, Simplex, Ring frame, Winding for spinning of PVA and MCU5 Cotton fiber.

TABLE 10

The following table shows Process Parameters for manufacturing of Air Rich Yarn using PVA and MCU5 Cotton fiber.

| Sr No. | Fibre Parameters | Count 12 Cw Air rich (PVA/MCU 5 Cotton) | |
|---|---|---|---|
| | Fibre denier | 1.2 Denier | |
| | Fibre Length | 38 mm | MCU 5 |
| | Fibre Upper half mean length | | 32.2 |
| | Micronaire | | 4.03 |
| | Fibre strength (gm/tex) | | 33.51 |
| 1 | Blowroom | PVA | |
| | Mixing | 100% PVA | 100% MCU 5 |
| | MBO Beater 1 Speed | 450 rpm | |
| | MBO Beater 2 Speed | 650 rpm | |
| | Vario Clean | | 650 rpm |
| | Unimix | | 500 rpm |
| | ERM | | 550 rpm |
| 2 | Carding | | |
| | Speed | 100 m/min | 150 m/min |
| | Cylinder Speed | 450 | 500 |
| | Licker In Speed | 650 | 950 |
| | Flat Speed | 7.5 inch/min | |
| | Flat Gauge | 12, 12, 16, 16, 16 | 12, 12, 10, 10, 10 |
| | Output Hank | 0.1 | 0.12 |
| 3 | Levelling/Breaker | RSB (levelling). | DO/6 |
| | Break Draft | 1.16 | 1.7 |
| | Roll Gauge | 46/50 | 38/42 |
| | Speed | 400 | 350 |
| | Doubling | 6 | 8 |
| | Input Hank | 0.1 | 0.12 |
| | Output Hank | 0.103 | 0.12 |
| 4 | Unilap (only for Cotton) | Not Applicable For PVA | E30 |
| | Speed | | 120 |
| | Break Draft | | 1.02 |
| | Doubling | | 20 |
| | Lap Hank | | 74 gm/mtr |
| 5 | Comber (only for Cotton) | Not Applicable For PVA | |
| | Nips/Min | | 350 |
| | Feed/Nip | | 5.2 mm |
| | Noil | | 15.50% |
| | Output Hank | | 0.12 |
| 6 | Finisher/Blender | RSB (Blending) | |
| | Break Draft | 1.16 | |
| | Speed | 450 m/min | |
| | Doubling | 6 cotton/1 PVA (PVA in Center) | |
| | Output Hank | 5.36 | |
| 7 | Simplex | | |
| | Rov Hank | 0.55 | |
| | Speed | 850 | |
| | Spacer | 9 mm | |
| | TM | 1.25 | |
| 8 | Ringframe | | |
| | Speed | 11600 | |
| | TM | 3.4 | |
| | Spacer | 4.5 | |
| | Break Draft | 1.2 | |
| | Yarn Count (English System) | 12s Ne | |
| 9 | Winding | | |
| | Winding Speed | 1300 m/min | |
| | Cone Weight | 2.52 kg | |

Example 7: Air Rich Yarn Made Using PVA and Cotton Fiber

Process parameters for manufacturing air rich yarn using PVA as water soluble material and of J34 Cotton as base material are provided in table 11 below. Parameters include all machine settings, Speed & Waste level of Blowroom, Carding, Draw Frame, Unilap, Comber, Simplex, Ring frame, Winding for spinning of PVA and J34 Cotton fiber.

TABLE 11

The following table shows Process Parameters for manufacturing of Air Rich Yarn using PVA and J34 Cotton.

| Sr No. | | Count 12 Cw Air rich (PVA/J34) | |
|---|---|---|---|
| 1 | Blowroom | PVA | Cotton |
| | Mixing | PVA (66% PVA + 34% Cotton) | 100% J 34 |
| | MBO Beater 1 Speed | 450 rpm | |
| | MBO Beater 2 Speed | 650 rpm | |
| 2 | Carding | | |
| | Speed | 120 m/min | 150 m/min |
| | Cylinder Speed | 450 | 500 |
| | Licker In Speed | 650 | 950 |
| | Flat Speed | 7.5 inch/min | |
| | Flat Gauge | 12, 12, 16, 16, 16 | 12, 12, 10, 10, 10 |
| | Output Hank | 0.1 | 0.12 |
| 3 | Levelling/Breaker | RSB (levelling). | DO/6 |
| | Break Draft | 1.16 | 1.7 |
| | Roll Gauge | 46/50 | 38/42 |
| | Speed | 400 | 350 |
| | Doubling | 6 | 8 |
| | Input Hank | 0.1 | 0.12 |
| | Output Hank | 0.13 | 0.12 |
| 4 | Unilap (only for Cotton) | Not Applicable For | E30 |

TABLE 11-continued

The following table shows Process Parameters for manufacturing of Air Rich Yarn using PVA and J34 Cotton.

| Sr No. | | Count 12 Cw Air rich (PVA/J34) | |
|---|---|---|---|
| | Speed | PVA | 120 |
| | Break Draft | | 1.02 |
| | Doubling | | 20 |
| | Lap Hank | | 74 gm/mtr |
| 5 | Comber (only for Cotton) | Not Applicable For | |
| | Nips/Min | PVA | 350 |
| | Feed/Nip | | 5.2 mm |
| | Noil | | 15.50% |
| | Output Hank | | 0.12 |
| 6 | Finisher/Blender | RSB (Blending) | |
| | Break Draft | 1.16 | |
| | Speed | 450 m/min | |
| | Doubling | 6 cotton/1 PVA (PVA in Center) | |
| | Output Hank | 5.36 | |
| 7 | Simplex | | |
| | Rov Hank | 0.55 | |
| | Speed | 850 | |
| | Spacer | 9 mm | |
| | TM | 1.25 | |
| 8 | Ringframe | | |
| | Speed | 11600 | |
| | TM | 3.5 | |
| | Spacer | 4.5 | |
| | Break Draft | 1.2 | |
| 9 | Winding | | |
| | Winding Speed | 1300 m/min | |
| | Cone Weight | 2.52 kg | |

Table 12 below comprises various examples of fabrics made using Air Rich Yarn. In this table column 4 has the description of the yarn used in pile of terry fabric and column number 9 has percentage of PVA used in it.

TABLE 12

Different Terry Towel Products made using Air Rich Yarn.

| 1 | 2 SIZE IN CM | | 3 | 4 Pile | 5 GR | 6 WEFT | 7 | 8 | 9 |
|---|---|---|---|---|---|---|---|---|---|
| SORT NO | LENGTH | WIDTH | GSM | COUNT | COUNT | COUNT | PICKS/CM | P.HEIGHT | % PVA |
| SDP202400 | 76.2 | 142.2 | 593 | 1/10 AIR RICH 13% | 2/20 KW | 1/12 OE | 18 | 5.6 | 13% |
| SDP202223 | 76.2 | 142.2 | 698 | 1/11 CB S-6 AIR RICH 15% | 2/20 KW | 1/16 KW | 19 | 7.7 | 15% |
| SDP201127 | 76.2 | 142.2 | 627 | 1/11 CB AIR RICH YARN 15% | 1/10 OE | 1/12 OE | 17 | 6.6 | 15% |
| SDP202434 | 76.2 | 142.2 | 698 | 1/11 MCU5 AIR RICH 16% | 2/20 KW | 1/16 KW | 18 | 8.1 | 16% |
| SDP201868 | 76.2 | 142.2 | 628 | 1/11 PIMA AIR RICH 17% | 2/20 KW | 1/16 KW | 17 | 7.2 | 17% |
| SDP202298 | 76.2 | 142.2 | 593 | 1/11 MCU-5 AIR RICH 16% | 2/20 KW | 1/12 OW | 17 | 6.6 | 16% |
| SDP202299 | 76.2 | 142.2 | 558 | 1/11 MCU-5 AIR RICH 16% | 2/20 KW | 1/12 KW | 16.8 | 6.5 | 16% |
| SDP203516 | 76.2 | 142.24 | 627 | 1/12 AIR RICH MCU-5 09% | 2/20 KW | 1/12 OW | 18 | 7.1 | 09% |

TABLE 12-continued

Different Terry Towel Products made using Air Rich Yarn.

| 1 | 2 SIZE IN CM | | 3 | 4 Pile | 5 GR | 6 WEFT | 7 | 8 | 9 |
|---|---|---|---|---|---|---|---|---|---|
| SORT NO | LENGTH | WIDTH | GSM | COUNT | COUNT | COUNT | PICKS/CM | P.HEIGHT | % PVA |
| SDP200914 | 76.2 | 147.3 | 725 | 1/12 CB J-34 AIR RICH YARN 16% | 2/20 KW | 1/13 OE | 20 | 8.1 | 16% |
| SDP202855 | 76.2 | 137.16 | 507 | 1/12 CB S-6 AIR RICH 85:15% | 2/20 KW | 1/12 OW | 18.5 | 4.7 | 15% |
| SDP201886 | 76.2 | 137.16 | 651 | 1/12 EGYP AIR RICH 16% | 2/20 KW | 1/16 KW | 19 | 7.3 | 16% |
| SDP202752 | 76.2 | 142.24 | 628 | 1/12 EGYPTION AIR RICH 85:15% | 2/20 KW | 1/16 KW | 18.5 | 7.4 | 15% |
| SDP203576 | 40.6 | 76.2 | 550 | 1/12 MCU 5 AIR 11% | 2/20 KW | 1/16 KW | 16 | 6.4 | 11% |
| SDP202525 | 76.2 | 142.24 | 628 | 1/12 MCU-5 85% + AIR RICH 15% | 2/24 KW | 1/16 KW | 18.5 | 7.5 | 15% |
| SDP202639 | 76.2 | 142.24 | 627 | 1/12 MCU-5 85% + AIR RICH 15% | 2/24 SKW | 1/16 SKW | 18.5 | 7.5 | 15% |
| SDP203572 | 76.2 | 137.1 | 500 | 1/12 OW AIR RICH 17% | 2/20 KW | 1/16 KW | 15.5 | 6.2 | 17% |
| SDP201742 | 76.2 | 142.2 | 663 | 1/13 MCU5 AIR RICH 15% | 2/20 KW | 1/16 KW | 19.5 | 8.3 | 15% |
| SDP202323 | 76.2 | 142.2 | 663 | 1/13 PIMA AIR RICH 13% | 2/20 KW | 1/12 OE | 19 | 8.8 | 13% |
| SDP203338 | 76.2 | 147.32 | 673 | 1/24 CB PIMA AIR RICH 11% | 2/20 KW | 1/16 KW | 16 | 6.2 | 11% |
| SDP202939 | 76.2 | 137.16 | 507 | 1/9.5 AIR RICH 17% | 2/20 KW | 1/16 KW | 15 | 5.4 | 17% |
| SDP202969 | 76.2 | 137.16 | 507 | 1/9.5 AIR RICH YARN 17% | 2/20 KW | 1/16 KW | 15 | 5.4 | 17% |
| SDP201655 | 76.2 | 142.2 | 776 | 2/14 AIR RICH 14% | 2/20 KW | 1/12 | 16.5 | 6.2 | 14% |
| SDP203597 | 76.2 | 147.3 | 674 | 2/20 CB AIR RICH 13% | 2/20 KW | 1/12 OW | 16 | 6.4 | 13% |
| SDP203598 | 76.2 | 147.3 | 741 | 2/20 CB AIR RICH 13% | 2/20 KW | 1/12 OW | 20 | 6.5 | 13% |
| SDP 202705 | 76.2 | 142.2 | 593 | 2/26 S-6 AIR RICH 15% | 2/20 KW | 1/16 KW | 18.5 | 5.4 | 15% |
| SDP202637 | 76.2 | 147.32 | 640 | 2/30 S-6 AIR RICH YARN 85:15% | 2/20 S | 1/16 SKW | 20 | 8.5 | 15% |
| SDP202709 | 76.2 | 147.32 | 640 | 2/30 S-6 AIR RICH 85;15% | 2/20 KW | 1/12 OW | 18.5 | 8.9 | 15% |
| SDP201860 | 76.2 | 142.2 | 800 | 3/20 AIR RICH 17% | 2/20 KW | 1/12 | 16 | 6.8 | 17% |
| SDP203572 | 137.16 | 76.2 | 500 | 1/12 OPEN END AIRRICH | 2/20 KW | 1/16 KW | 15.5 | 6.2 | 12% |

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the spirit or scope of the present invention as defined. It is also to be understood that the terminology used herein is for the purpose of describing particular embodiments only, and is not intended to limit the scope of present invention.

What is claimed is:

1. A yarn comprising a plurality of base material staple fibers, wherein the plurality of base material staple fibers are S or Z twisted together, wherein the S or Z twisted plurality of base material staple fibers are arranged to form a plurality of interlinked through pores between said base material staple fibers, wherein the plurality of interlinked through pores includes pores that open on to a surface of the yarn and provide fluid passageway from the surface of the yarn into pore spaces between said base material staple fibers, and wherein the plurality of interlinked through pores are distributed homogenously across a cross section of the yarn comprising the S or Z twisted plurality of base material staple fibers.

2. The yarn as claimed in claim 1, wherein each of the plurality of base material staple fibers comprises a natural or manmade textile fiber or a blend of two or more fibers; selected from the group consisting of cotton, silk, modal, acrylic, a blend of cotton and bamboo, a blend of cotton and sea weed, a blend of cotton and silver, a blend of cotton and charcoal, a blend of polyester and cotton, a blend of polyester and viscose, a blend of poly(trimethylene terephthalate) and cotton, a blend of Lyocell and cotton, and a blend of cotton and modal or any combination thereof.

3. A fabric woven, knitted or manufactured using at least one yarn comprising a plurality of base material staple fibers, wherein the plurality of base material staple fibers are S or Z twisted together, wherein the S or Z twisted plurality of base material staple fibers are arranged to form a plurality of interlinked through pores between said base material staple fibers, wherein the plurality of interlinked through pores includes pores that open on to a surface of the yarn and provide fluid passageway from the surface of the yarn into pore spaces between said base material staple fibers, and wherein the plurality of interlinked through pores are distributed homogenously across a cross section of the yarn comprising the S or Z twisted plurality of base material staple fibers.

4. The fabric as claimed in claim 3, wherein the fabric is a flat fabric.

5. The fabric as claimed in claim 3, wherein the fabric is a terry fabric.

6. The fabric as claimed in claim 3, wherein the yarn is a warp yarn, a weft yarn, a pile yarn or any combination thereof.

7. A yarn comprising a plurality of base material staple fibers and a plurality of water soluble material fibers, wherein the plurality of base material staple fibers and the plurality of water soluble material fibers are S or Z twisted together, wherein the plurality of water soluble material fibers are distributed homogenously across a cross section of the yarn, and wherein within the S or Z twisted plurality of base material and water soluble material fibers, dispersion of the plurality of water soluble material fibers between the plurality of base material staple fibers is such that removal of the plurality of water soluble material fibers from the yarn forms a plurality of interlinked through pores between said base material staple fibers, said plurality of interlinked through pores being distributed homogenously across a cross section of the yarn comprising the S or Z twisted plurality of base material staple fibers and including pores that open on to a surface of the yarn and provide fluid passageway from the surface of the yarn into pore spaces between the base material staple fibers.

8. The yarn as claimed in claim 7, wherein the plurality of water soluble material fibers comprises a plurality of polyvinyl alcohol fibers.

9. The yarn as claimed in claim 7, wherein weight of the plurality of water soluble material fibers is not greater than 25% of a sum of:

(i) weight of base material staple fibers of any single type that are included within the yarn; and (ii) weight of the plurality of water soluble material fibers.

10. The yarn as claimed in claim 7, wherein weight of the plurality of water soluble material fibers is not less than 8% of a sum of:

(i) weight of base material staple fibers of any single type that are included within the yarn; and (ii) weight of the plurality of water soluble material fibers.

11. The yarn as claimed in claim 7, wherein weight of the plurality of water soluble material fibers is between 8% and 25% of a sum of:

(i) weight of base material staple fibers of any single type that are included within the yarn; and (ii) weight of the plurality of water soluble material fibers.

12. A fabric woven, knitted or manufactured using at least one yarn comprising a plurality of base material staple fibers and a plurality of water soluble material fibers, wherein the plurality of base material staple fibers and the plurality of water soluble material fibers are S or Z twisted together, wherein the plurality of water soluble material fibers are distributed homogenously across a cross section of the yarn, and wherein within the S or Z twisted plurality of base material and water soluble material fibers, dispersion of the plurality of water soluble material fibers between the plurality of base material staple fibers is such that removal of the plurality of water soluble material fibers from the yarn forms a plurality of interlinked through pores between said base material staple fibers, said plurality of interlinked through pores being distributed homogenously across a cross section of the yarn comprising the S or Z twisted plurality of base material staple fibers and including pores that open on to a surface of the yarn and provide fluid passageway from the surface of the yarn into pore spaces between the base material staple fibers.

13. The fabric as claimed in claim 12, wherein the plurality of water soluble material fibers comprises a plurality of polyvinyl alcohol fibers.

14. The fabric as claimed in claim 12, wherein weight of the plurality of water soluble material fibers is not greater than 25% of a sum of:

(i) weight of base material staple fibers of any single type that are included within the yarn; and (ii) weight of the plurality of water soluble material fibers.

15. The fabric as claimed in claim 12, wherein weight of the plurality of water soluble material fibers is not less than 8% of a sum of:

(i) weight of base material staple fibers of any single type that are included within the yarn; and (ii) weight of the plurality of water soluble material fibers.

16. The fabric as claimed in claim 12, wherein weight of the plurality of water soluble material fibers is between 8% and 25% of a sum of:

(i) weight of base material staple fibers of any single type that are included within the yarn; and (ii) weight of the plurality of water soluble material fibers.

* * * * *